US010484768B2

(12) United States Patent
Lundgard

(10) Patent No.: US 10,484,768 B2
(45) Date of Patent: Nov. 19, 2019

(54) SPEAKER SYSTEM

(71) Applicant: Eric James Lundgard, Midland, MI (US)

(72) Inventor: Eric James Lundgard, Midland, MI (US)

( * ) Notice: Subject to any disclaimer, the term of this patent is extended or adjusted under 35 U.S.C. 154(b) by 30 days.

(21) Appl. No.: 15/985,241

(22) Filed: May 21, 2018

(65) Prior Publication Data

US 2018/0343509 A1 Nov. 29, 2018

Related U.S. Application Data

(60) Provisional application No. 62/509,988, filed on May 23, 2017.

(51) Int. Cl.

| | |
|---|---|
| ***H04R 1/02*** | (2006.01) |
| ***H04R 1/26*** | (2006.01) |
| ***H04R 1/28*** | (2006.01) |

(52) U.S. Cl.

CPC ..... *H04R 1/025* (2013.01); *H04R 1/26* (2013.01); *H04R 1/2803* (2013.01); *H04R 1/2869* (2013.01)

(58) Field of Classification Search

CPC ..... H04R 1/025; H04R 1/26; H04R 1/2803; H04R 1/2869; H04R 1/02; H04R 1/026

USPC ..... 381/386, 385, 300, 374, 307, 387, 361

See application file for complete search history.

(56) References Cited

U.S. PATENT DOCUMENTS

| | | | | |
|---|---|---|---|---|
| 1,763,048 | A | 6/1930 | Hopkins | |
| 1,891,968 | A | 12/1932 | Bidwell et al. | |
| 2,642,948 | A | 6/1953 | Olson et al. | |
| 2,834,423 | A | 5/1958 | Bradford | |
| 2,840,181 | A | 6/1958 | Wildman | |
| 2,973,824 | A | 3/1961 | Pinski | |
| 3,101,810 | A | 8/1963 | Doschek | |
| 3,233,695 | A | 2/1966 | Hutchins | |
| 3,509,282 | A | 4/1970 | Ashworth | |
| 3,715,008 | A | 2/1973 | Lover | |
| 4,289,929 | A * | 9/1981 | Hathaway | H04R 1/02 181/145 |
| 4,714,133 | A | 12/1987 | Skaggs, Jr. | |
| 5,854,435 | A | 12/1998 | Kim | |
| 5,929,393 | A | 7/1999 | Jeter, Jr. | |
| 6,411,720 | B1 | 6/2002 | Pritchard | |
| 6,866,116 | B2 | 3/2005 | Peng | |
| 8,397,860 | B2 | 3/2013 | Rodgers | |
| 2009/0238384 | A1 * | 9/2009 | Beauchamp | H04R 5/02 381/306 |
| 2015/0319525 | A1 * | 11/2015 | O'Polka | H04R 1/026 381/300 |

* cited by examiner

*Primary Examiner* — Thjuan K Addy

(74) *Attorney, Agent, or Firm* — Joe R. Prieto

(57) ABSTRACT

A free-standing, portable speaker system including (1) at least a first cabinet enclosure of a first size generally rectangular in shape and having six sides; wherein the at least first cabinet enclosure includes at least a first driver and at least a second driver; and a planar partition soundboard member; wherein the partition soundboard member is adapted for enhancing the quality of sound from said first cabinet enclosure; and (2) at least a third driver releasably attached to the first cabinet enclosure; wherein the at least third driver in combination with the at least first and second drivers enclosed in the at least first cabinet enclosure enhances the quality of sound from said speaker system.

14 Claims, 5 Drawing Sheets

SPEAKER SYSTEM

BACKGROUND

Field

The present invention relates to a speaker system including an enclosure and more specifically to a speaker system including a resonant loudspeaker enclosure utilizing a soundboard.

Background

Heretofore, loudspeaker enclosures have generally been designed in such a way that resonance is minimized; and typically, known loudspeaker enclosures do not incorporate a soundboard or similar vibrating apparatus because the soundboard allows resonance to be added to the audio output created by the loudspeaker. A few previously known loudspeaker cabinets that do incorporate, in various ways, soundboards constructed from thin panels of wood (for example, spruce), do not differentiate the range of the audio frequency spectrum that the soundboard allows resonance to be enhanced within.

When all portions of the audible frequency spectrum have an increase in resonance, including the portion on which musical vocals primarily fall (for example, in the range of from about 100 hertz (Hz) to about 1,400 Hz), an echo, or other distortion can be generated in the vocals, which, in turn, tends to sound somewhat unpleasant or unnatural.

Heretofore, the standard theory in the industry of high fidelity speaker design is that it is desirable to minimize resonance when designing speaker enclosures, because it is theorized that minimizing resonance generated by the enclosure is ideal for maintaining fidelity to an original recorded audio signal. If an enclosure itself is allowed to vibrate or resonate excessively, it is theorized that the vibration or resonance adulterates the fidelity to the original recorded audio signal.

The above standard theory is appropriately followed for achieving the goal of perfectly replicating the audio signal as it is on the recording. However, elements of the natural sound of live music, including resonance, are typically lost during the standard recording process. It is desired to provide a loudspeaker driver enclosure and system that assists in recovering resonant tones typically lost during the recording process; and while at the same time minimizing vocal distortion or echo.

SUMMARY

The present invention is directed to a speaker system including at least first and second loudspeaker driver enclosures that aid in more realistically conveying the impression of live music by re-introducing, or accentuating, (at specific predetermined portions of the audible frequency spectrum) resonant tones typically lost during the recording process. Accordingly, one of the objectives of the present invention, rather than eliminating resonance, is to add resonance back into the final sound projected from a speaker/enclosure, such that the final effect will be to make the sound emanating from the speaker/enclosure as lifelike as possible. The present invention attempts to increase resonance by instrumentalizing the speaker enclosure itself, causing the enclosure to act in a manner similar to a stringed instrument body.

To meet the above objective, the low and high range drivers (woofer and tweeter, respectively) can, in one illustrative embodiment, be placed in a highly resonant lower first enclosure (or cabinet or box) containing a spruce (or other similar material) soundboard, while the mid-range driver (through which the majority of the human vocal range is replicated) can be placed in a separate second smaller enclosure (or cabinet or box), which is designed to be minimally resonant.

The high range driver(s) produces high frequency harmonics which give many stringed instruments a characteristic sound with a characteristic amount of resonance. Placing the high range driver in the same enclosure as the low range driver, allows high range instrumental notes to take on increased resonance by mixing the high frequency emanation with the highly resonant, low frequency emanation generated by the larger driver and sound board. At the same time (or substantially simultaneously), the majority of the sound produced by the midrange driver remains minimally-resonant, comparatively, thus allowing the vocals to retain a natural character.

To accomplish this beneficial feature, a first cabinet enclosure is fitted with a soundboard made from thin material such as wood (e.g., spruce). The soundboard vibrates in accordance with the vibration primarily generated from backdraft sound waves of the larger, low frequency speaker drivers.

In one general embodiment, the speaker system of the present invention includes:

(a) at least a first enclosure having a plurality of walls forming at least a first compartment having at least a first interior compartment space;

(b) at least a first driver having a frequency of greater than about 20 Hz:

(c) at least a second driver having a frequency of less than about 20,000 Hz;

(d) at least a third driver having a frequency of from about 100 Hz to about 4,000 Hz; and (e) at least a first soundboard;

wherein the at least first driver (b), the at least second driver (c), and the at least first soundboard (e) are disposed in the at least first interior compartment space of the at least first enclosure (a); and wherein the at least third driver (d) is disposed external to the at least first compartment of the at least first enclosure (a) such that the at least third driver (d) is separate from the at least first driver (b), the at least second driver (c) and the at least first soundboard (e); and wherein the combination of the at least first, second and third drivers and the at least first soundboard increases the resonance of, and enhances the quality of, the sound from the speaker system.

In the above embodiment, the third driver (midrange driver) (d) may be mounted on the first enclosure without the third driver (d) being enclosed in an enclosure and is disposed separately from the other drivers in one embodiment.

In another embodiment, the midrange driver (d) may be provided in an additional separate second enclosure, smaller than the first enclosure. The second enclosure may be mounted on top of the larger first enclosure as a separate enclosure.

In still another embodiment, a single housing cabinet enclosure may be used to house the drivers in at least two separate compartments of the cabinet enclosure; and the single housing enclosure may be of a size to encapsulate both a large first cabinet compartment portion and a small second cabinet compartment portion which is partitioned from the large first cabinet compartment portion such that the small second cabinet compartment portion encapsulates the midrange driver (d) separately from the other first and second drivers enclosed in the larger first cabinet compartment portion.

In accordance with the present invention, a free-standing, portable speaker system may include (I) at least a first cabinet enclosure of a first size having:

(a) a bottom panel, (b) a pair of side panels upward-standing from said bottom panels in spaced relationship, (c) a rear panel upward-standing from said bottom panel, (d) a front panel upward-standing from said bottom panel in spaced relationship with respect to said rear panel; wherein the front panel includes at least a first driver slot and at least a second driver slot, (e) a top panel carried by said side panels, front panel and rear panel; wherein the front panel, the side panels, the top panel and the rear panel defines the first cabinet enclosure, and wherein the first cabinet enclosure defines an enclosure interior;

(f) at least a first driver (speaker) mounted in said first driver slot in the front panel and speaker wiring connected to said first speaker for electrically energizing said speaker;

(g) at least a second driver (speaker) mounted in said second driver slot in the front panel and speaker wiring connected to said second speaker for electrically energizing said speaker; and (h) a planar partition soundboard member; wherein the partition member is mounted between said side panels of the first compartment in closely spaced relationship with respect to said rear panel of the first compartment for dividing said first compartment interior space into at least two spaces.

Generally, the partition soundboard member is mounted in a vertical plane parallel to the vertical plane of the front panel, perpendicular to the vertical planes of the side panels, and perpendicular to the horizontal planes of the top and bottom panels of the first compartment such that at least two interior spaces are formed in the first compartment including a front interior space between the front panel and the soundboard member and a back interior space between the soundboard member and the rear panel. The planar partition soundboard member forms a coterminous wall between the front interior space and the back interior space and wherein the partition soundboard member is mounted in a vertical plane parallel to the vertical plane of the front panel of the first compartment and perpendicular to the vertical planes of the side panels of the first compartment. The partition soundboard member is adapted for enhancing the quality of sound from the speaker system.

In accordance with the present invention, a free-standing, portable speaker system, in addition to (I) the at least first cabinet enclosure of a first size, may include:

(II) at least a second cabinet enclosure separate and different from the at least first cabinet enclosure; wherein the at least second cabinet enclosure is of a second size smaller than the at least first cabinet enclosure; wherein the at least second cabinet enclosure includes:

(i) a bottom panel, (j) a pair of side panels upward-standing from said bottom panels in spaced relationship, (k) a rear panel upward-standing from said bottom panel, (l) a front panel upward-standing from said bottom panel in spaced relationship with respect to said rear panel; wherein the front panel includes at least a third driver slot;

(m) a top panel carried by said side panels, front panel and rear panel; wherein the front panel, the side panels, the top panel and the rear panel defines the at least second cabinet enclosure, and wherein the at least second cabinet enclosure defines an enclosure interior; and (n) at least a third speaker mounted in said third driver slot in the front panel of the second cabinet; wherein the third speaker includes wiring connected to said third speaker for electrically energizing said speaker; wherein the at least second cabinet enclosure having the at least third speaker in combination with the at least first cabinet enclosure having the at least first and second speakers enhances the quality of sound from said speaker system.

Another general embodiment of the present invention includes a process of increasing the resonance of a speaker system comprising the steps of:

(i) providing at least a first cabinet enclosure of a first size; and (ii) placing a planar partition soundboard member in the at least first cabinet enclosure; wherein the partition member is adapted for enhancing the quality of sound from the speaker system.

Other systems, methods, device features, and advantages of the present invention will be or become apparent to one with skill in the art upon examination of the following drawings and detailed description. It is intended that all such additional systems, methods, device features, and advantages be included within this description, be within the scope of the present invention, and be protected by the accompanying claims.

BRIEF DESCRIPTION OF THE DRAWINGS

The drawings provided herein illustrate the primary parts of the present invention and how each part has been arranged using perspective illustrations to better understand the principles applied herein while not involving specific methods of connection between the primary components described. In addition, the embodiments described herein are not necessarily preferred choices of the process, apparatus, or material composition of the described embodiments, which might otherwise limit the present invention from being constructed with alternate materials for other uses.

The novel features of the present invention are set forth with particularity in the appended claims. The present invention, together with further objects and advantages thereof, may best be understood by reference to the following drawings; the embodiments of the present invention are shown in the several figures which are provided herein by way of example only.

DETAILED DESCRIPTION

Figure 1:
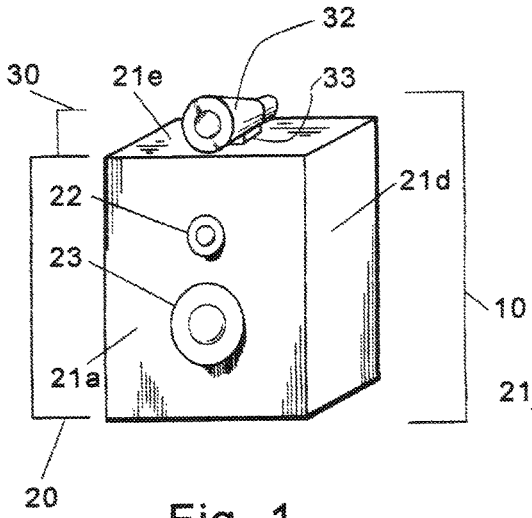
FIG. 1 is a front perspective view showing one embodiment of a speaker system of the present invention.

In the following detailed description, reference is made to the accompanying drawings, which form a part hereof, and in which is shown, by way of illustration, specific embodiments in which the present invention may be practiced. In the drawings, like reference numerals describe substantially similar components throughout the several views. These embodiments are described in sufficient detail to enable those skilled in the art to practice the present invention. Other embodiments may be utilized and structural, mechanical or logical changes, etc. may be made without departing from the scope of the present invention.

"Acoustic resonance" as discussed herein, consists of a given acoustic system amplifying a sound or sounds, whose frequency matches one or more of its own natural frequencies of vibration.

The speaker system of the present invention includes at least a first cabinet enclosure encapsulating one or more drivers (for example, at least first and second drivers) and a soundboard. In addition, the speaker system of the present invention includes a third midrange driver which is disposed external to the first cabinet enclosure such that the third driver is partitioned off, separated and apart, or isolated from the drivers and soundboard in the first cabinet enclosure (i.e., the resonant portion of the speaker system).

One advantage of the present invention is that the present invention speaker system produces the impression of increased resonance, particularly on, but not limited to, stringed and percussion instruments, while maintaining a standard amount of resonance in the usual human vocal range, thus making the music played through the cabinet sound more realistic or live, and less like a usual recording.

Figure 2:
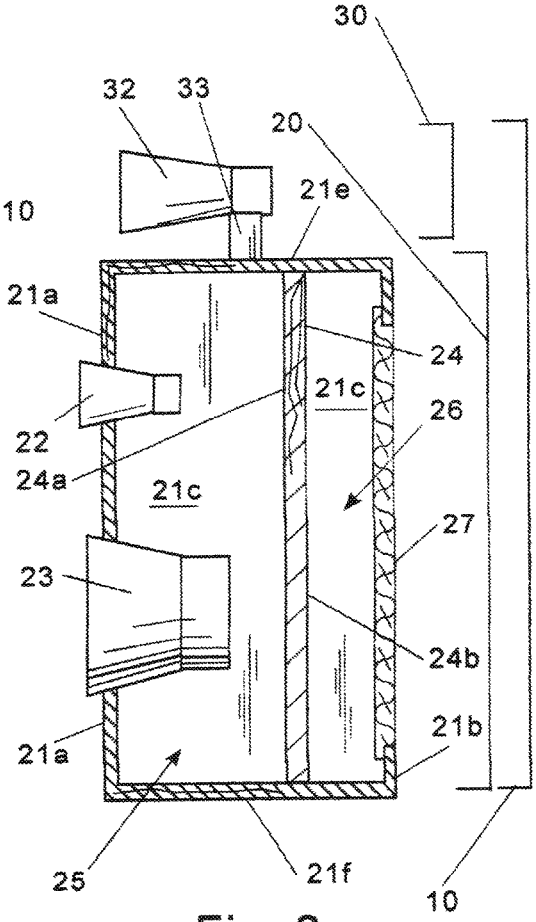
FIG. 2 is a side, cross-sectional view of the speaker system of FIG. 1
Figure 3:
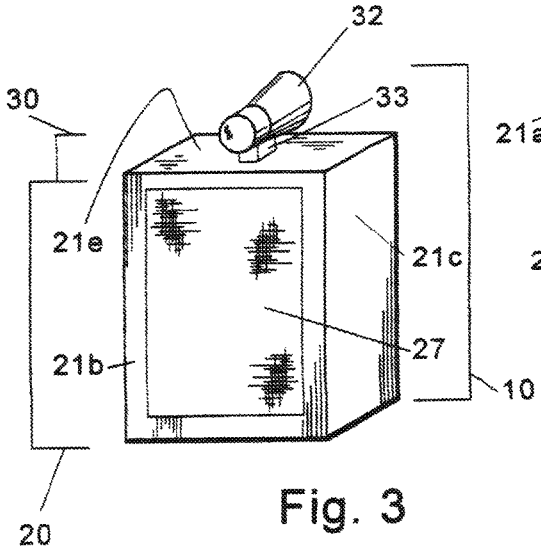
FIG. 3 is a back perspective view of a speaker system of the present invention shown in FIG. 1.
Figure 4:
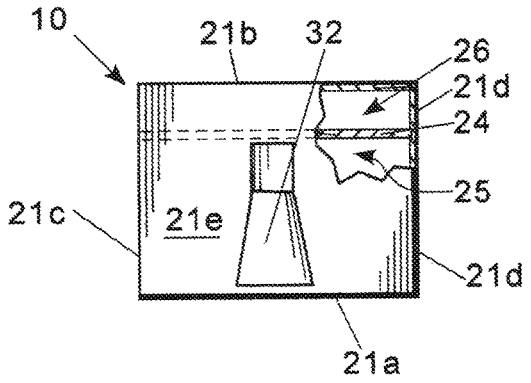
FIG. 4 is a top elevation view, partly broken away, of the speaker system of the present invention shown in FIG. 1.
Figure 5:
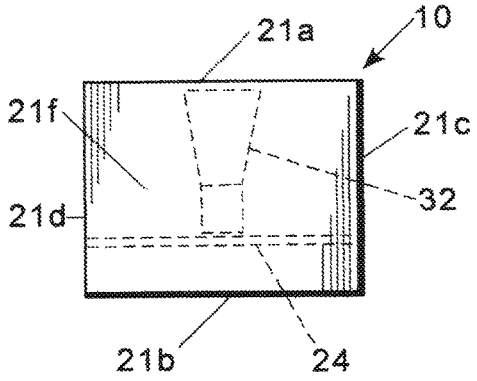
FIG. 5 is a bottom elevation view of the speaker system of the present invention shown in FIG. 1.

With reference to FIGS. 1-5, there is shown one broad embodiment of the present invention speaker system generally indicated by numeral 10 including (i) a first cabinet housing enclosure generally indicated by numeral 20 in combination with (ii) a driver generally indicated by numeral 30 (e.g. a midrange driver 32) which is disposed (i.e., mounted) outside of, and on a surface of the first cabinet housing enclosure 20. The cabinet housing enclosure 20 houses a first driver 22, second driver 23, and a planar partition soundboard 24. The first cabinet housing enclosure 20 of the present invention is a highly resonant rectangular housing enclosure 20 including six sides (walls or panels) 21*a*-21*f* forming an interior enclosure of the cabinet 20. The six sides or panels forming the interior enclosure of the cabinet 20 include a front panel 21*a*, a rear or back panel 21*b*, a first side panel 21*c*, a second side panel 21*d*, a top panel 21*a*, and a bottom panel 21*f*. The sides or panels 21*a*-21*f* of the first cabinet enclosure 20 may be made from wood paneling of standard resonance. The first driver 22, second driver 23 and planar soundboard 24 are disposed in the interior of the housing enclosure of the first cabinet 20.

The planar soundboard member 24 can be mounted between the interior surfaces of the first and second side panels 21*c* and 21*d* of the first compartment 20 in closely spaced relationship with respect to the rear or back panel 21*b* of the first compartment 20 for partitioning or dividing the interior space of the enclosure 20 into at least two spaces including space 25 and space 26.

Generally, the partition soundboard member 24 can be mounted in a vertical plane parallel to the vertical plane of the front panel 21*a* of the first compartment 20, perpendicular to the vertical planes of the side panels 21*c* and 21*d*, and perpendicular to the horizontal planes of the top and bottom panels 21*e* and 21*f* of the first compartment 20 such that at least two interior spaces 25 and 26 are formed in the first compartment 20. The front interior space 25 lies between the interior surface of the front panel 21*a* and the front surface 24*a* of the soundboard member 24. The back interior space 26 lies between the back surface 24*b* of the soundboard member 24 and the rear or back panel 21*b* in combination with vented back panel 27. The planar partition soundboard member 24 forms a coterminous wall between the front interior space 25 and the back interior space 26, that is, the soundboard member 24 is the common wall to the compartment space 25 and the compartment space 26; and the soundboard member 24 partitions or separates space 25 from space 26.

The soundboard 24 can be made from wood of highly resonant character such as spruce, maple, and the like. The front panel (also referred to as a baffle) 21*a* can be made of material of standard resonance specification being constructed with cutouts for receiving both the first driver 22 such as a high-range driver 22 and the second driver 23 such as a low-range driver 23.

The high range driver 22 can be a conventional driver designed so as to be recognized by those skilled in the art as having a frequency range above the standard human vocal frequency range. Although not to be limited thereby, generally, the range of the high frequency range driver 22 can be, for example, less than about 20,000 Hz in one embodiment; from about 1,500 Hz to about 20,000 Hz in another embodiment, from about 2.000 Hz to about 20,000 Hz in still another embodiment, and from about 4,000 Hz to about 20,000 Hz in yet another embodiment.

The low range driver 23 can be a conventional driver designed so as to be recognized by those skilled in the art as having a frequency range lower than the standard human vocal frequency range. Although not to be limited thereby, generally, the frequency range of the low range driver 23 can be, for example, greater than about 20 Hz in one embodiment, from about 20 Hz to about 300 Hz in another embodiment, from about 20 Hz to about 200 Hz in still another embodiment, and from about 20 Hz to about 100 Hz in yet another embodiment.

The soundboard 24 can be a vibrating soundboard 24; and can be made of, for example, a highly resonant material such as, but not limited to, spruce, maple, mahogany, other woods, and the like. The soundboard 24 may also be made of a combination of two or more different materials such as maple and mahogany which are traditionally used as alternatives to spruce.

Generally, in one embodiment, the thickness of the soundboard 24 may be between about 0.3175 centimeters (cm) (⅛ inch) and 0.9525 cm (⅜ inch) depending on the type of wood selected for the soundboard 24 and depending on the overall enclosure/driver sizing, although the thickness of said soundboard may vary in the event that a much larger cabinet is desired.

In one embodiment, the density of wood used for the soundboard 24 may be from about 0.16 kilograms per cubic meter ($kg/m^3$) to about 1.3 $kg/m^3$, from about 0.3 $kg/m^3$ to about 0.8 $kg/m^3$ in another embodiment, and from about 0.4 $kg/m^3$ to about 0.7 $kg/m^3$ in still another embodiment. In one embodiment, the density of the wood can be measured on the basis of "air dried seasoned" wood, i.e., wherein the wood is typically dried to ambient conditions that results in about 20 percent (%) retained moisture content per unit weight of the wood.

In the embodiment shown in FIGS. 1-5, a third driver 32 such as a midrange driver 32 may be mounted to any of the outer surfaces of the first cabinet 20 such that the midrange driver 32 is open to the atmosphere. i.e., the midrange driver 32 does not include an enclosure enclosing the midrange driver 32. The midrange driver 32 may be mounted to the first cabinet 20 by any well know means such as a speaker bracket 33. The midrange driver 32 may be, for example, a horn-loaded driver which does not require an enclosure.

The midrange driver 32 can be a conventional driver designed so as to be recognized by those skilled in the art as having a frequency range at or near the standard human vocal frequency range. Although not to be limited thereby, generally, the range for the midrange driver 32 can be, for example, from about 100 Hz to about 4.000 Hz in one embodiment, from about 150 Hz to about 3,000 Hz in another embodiment, and from about 200 Hz to about 1,800 Hz in still another embodiment.

The back panel 21*b* of the first cabinet enclosure 20 of the present invention may include the vented back panel 27. The back panel 21*b*/27 generally is separate and different from the soundboard 24. The back panel 27 may be designed to be a porous material, but also to be a protective cover for the soundboard 24. For example, the material 27 may be fabric, metal screen or other mesh material. Since the soundboard 24 is relatively thin and fragile, in a preferred embodiment, the soundboard 24 should not be directly open to the atmosphere from the rear of the first cabinet 20 and the soundboard 24 should not form the back panel 21*b*, as the soundboard 24 may likely be damaged by everyday use, by movement of the speaker, and/or by handling of the speaker by a user. In the embodiment shown in FIGS. 1-5, space 26 may be formed inbetween the soundboard 24 and back panel 27. In one embodiment, the back panel 21*b* can be a picture-frame type wall with the porous material 27 supported or attached to the center of the picture-frame type panel 21*b*.

Figure 6:
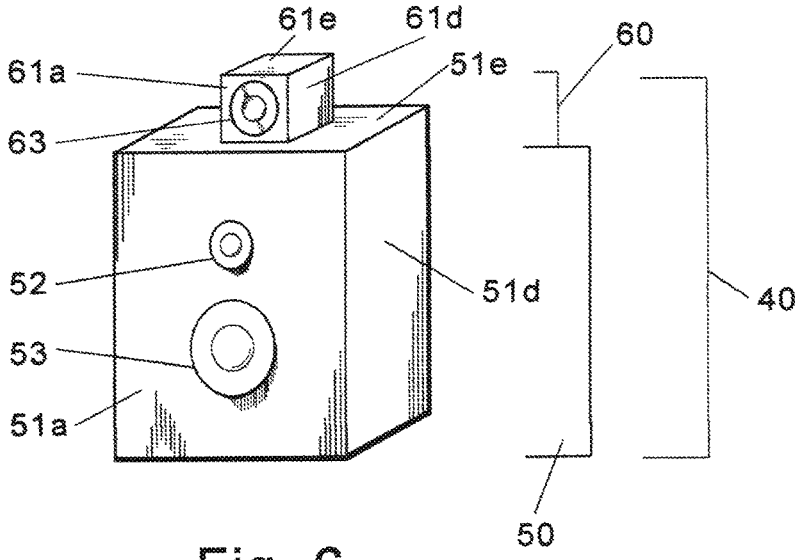
FIG. 6 is a front perspective view showing another embodiment of a speaker system of the present invention.
Figure 7:
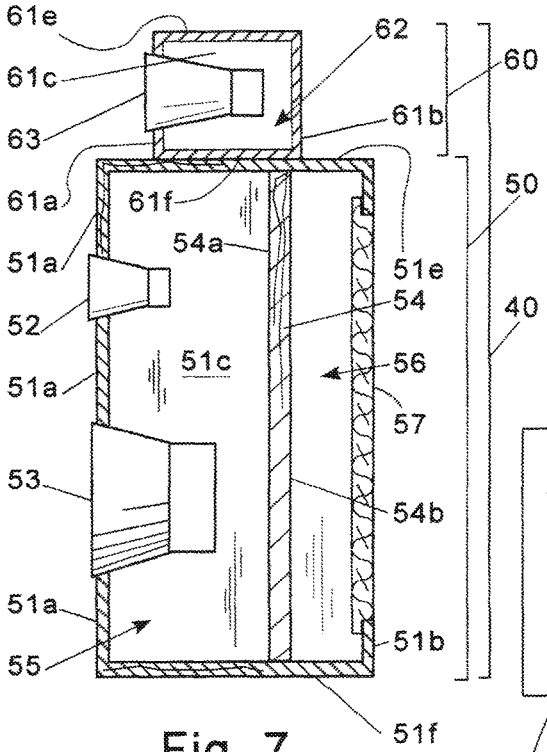
FIG. 7 is a side, cross-sectional view of the speaker system of FIG. 6.
Figure 8:
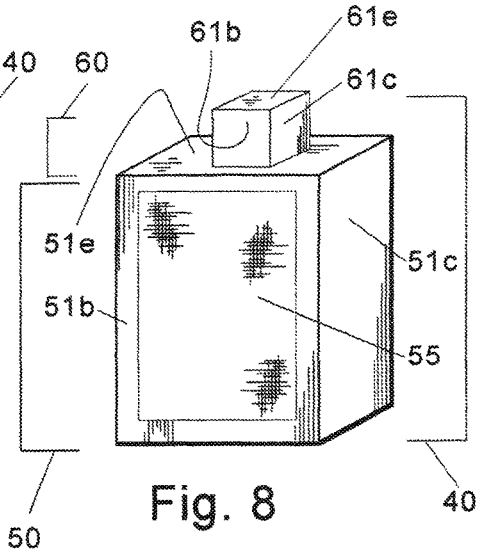
FIG. 8 is a back perspective view of a speaker system of the present invention shown in FIG. 6.
Figure 9:
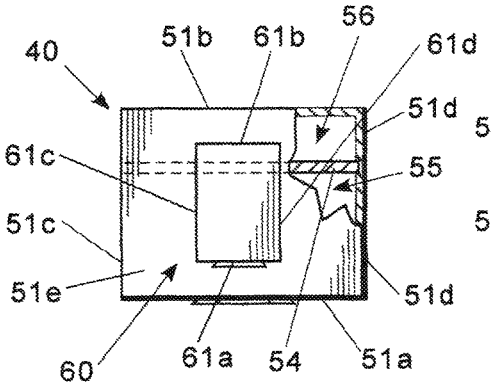
FIG. 9 is a top elevation view, partly broken away, of the speaker system of the present invention shown in FIG. 6.
Figure 10:
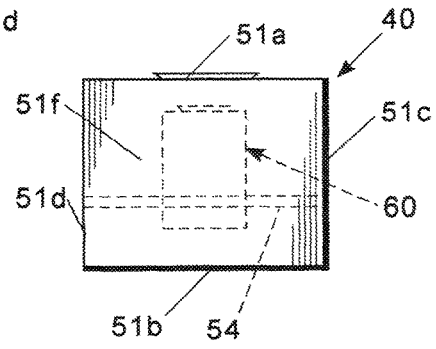
FIG. 10 is a bottom elevation view of the speaker system of the present invention shown in FIG. 6.

With reference to FIGS. 6-10, there is shown another broad embodiment of the present invention speaker system generally indicated by numeral 40 including a first cabinet housing enclosure generally indicated by numeral 50 in combination with a second cabinet housing enclosure generally indicated by numeral 60.

The first cabinet enclosure 50 shown in FIGS. 6-10 may be the same as the first cabinet enclosure 20 shown in FIGS. 1-5. In this embodiment, the first cabinet enclosure 50 is a highly resonant rectangular housing enclosure 50 including six sides (or panels) 51*a*-51*f* forming an interior enclosure of the cabinet 50. The six panels forming the interior enclosure of the cabinet 50 include a front panel 51*a*, a back panel 51*b*, a first side panel 51*c*, a second side panel 51*d*, a top panel 51*c*, and a bottom panel 51*f*. The panels 51*a*-51*f* of the first cabinet enclosure 50 may be made from wood paneling of standard resonance. The interior of the housing enclosure 50 includes a first driver 52, a second driver 53 and a planar soundboard 54. The first driver 52, the second driver 53 and the soundboard 54 may be the same as the first driver 22, the second driver 23 and soundboard 24, respectively, as described above with reference to FIGS. 1-6.

The planar partition soundboard member 54 can be mounted between the interior surfaces of the first and second side panels 51*c* and 51*d* of the first compartment 50 in closely spaced relationship with respect to the rear or back panel 51*b* of the first compartment 50 for dividing the interior space of the enclosure 50 into at least two spaces including a front interior space 55 and a back interior space 56.

Generally, the partition soundboard member 54 can be mounted (i) in a vertical plane parallel to the vertical plane of the front panel 51*a* of the first compartment 50, (ii) perpendicular to the vertical planes of the side panels 51*i* and 51*d*, and (iii) perpendicular to the horizontal planes of the top and bottom panels 51*i* and 51 *f* of the first compartment 50 such that at least the two interior spaces 55 and 56 are formed in the first compartment 50. The front interior space 55 lies between the interior surface of the front panel 51*a* and the front surface 54*a* of the soundboard member 54. The back interior space 56 lies between the back surface 54*b* of the soundboard member 54 and the interior surface of the rear panel 51*b* and back panel 57. The planar partition soundboard member 54 forms a coterminous wall between the front interior space 55 and the back interior space 56, that is, soundboard member 54 is the common wall to the compartment space 55 and the compartment space 56.

Similar to soundboard 24, the soundboard 54 can be a vibrating soundboard 54; and can be made of, for example, a highly resonant material such as, but not limited to, spruce, maple, mahogany, other woods, and the like. The soundboard 54 may also be made of a combination of two or more different materials such as maple and mahogany which are traditionally used as alternatives to spruce.

With reference to FIGS. 6-10 again, the second cabinet enclosure 60 of the present invention may be the same shape and structure as the first cabinet enclosure 50 except that, in one embodiment, the size of the second cabinet enclosure 60 may be of a smaller size than the first cabinet enclosure 50 to accommodate at least one driver. In the embodiment shown in FIGS. 6-10, the second cabinet enclosure 60 includes a rectangular housing enclosure 60 including six sides (or panels) 61*a*-61*f* forming an interior enclosure 62 of the cabinet 60. The six panels forming the interior enclosure of the second cabinet 60 include a front panel 61*a*, a back panel 61*b*, a first side panel 61*c*, a second side panel 61*d*, a top panel 61*e*, and a bottom panel 61*f*. Five of the sides or panels 61*b*-61*f* can be made from wood of standard resonance characteristics for speaker construction, and the sixth side, being the front panel (or baffle) 61*a*, may be made with a cutout or slot for housing a third driver 63 such as a mid-range driver 63 with a resonance suitable to said driver 63. In this second embodiment, the second cabinet 60 containing the midrange driver 63 may be mounted to the first cabinet 50 on any of the surfaces of the panels 51*a*-51*f*; or the second cabinet 60 containing the midrange driver 63 may be simply laid on the top planar surface of the first cabinet 50 without an attachment. In an alternative embodiment (not shown), the second cabinet 60 containing the midrange driver 63 may be built in an enclosure that is nested within the larger resonant enclosure 50, so long as the former cabinet 60 is made of significantly less resonant material.

In the embodiment shown in FIGS. 6-10, the midrange driver 63 may be disposed in the interior space 62 of the second cabinet 60. The midrange driver 63 can be designed the same as the midrange driver 32 described above with reference to FIGS. 1-5. For example, the midrange driver 63 may be designed to carry the majority of the vocal range as situated on the frequency spectrum. Generally, the range can be, for example, from about 100 Hz to about 4,000 Hz in one embodiment, from about 150 Hz to about 3,000 Hz in another embodiment, and from about 200 Hz to about 1,800 Hz in still another embodiment.

Figure 11:
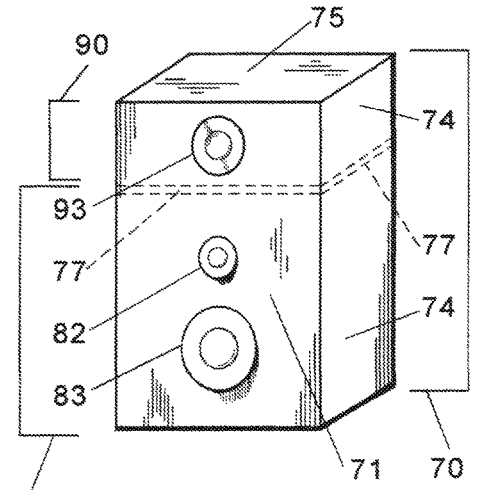
FIG. 11 is a front perspective view showing still another embodiment of a speaker system of the present invention.
Figure 12:
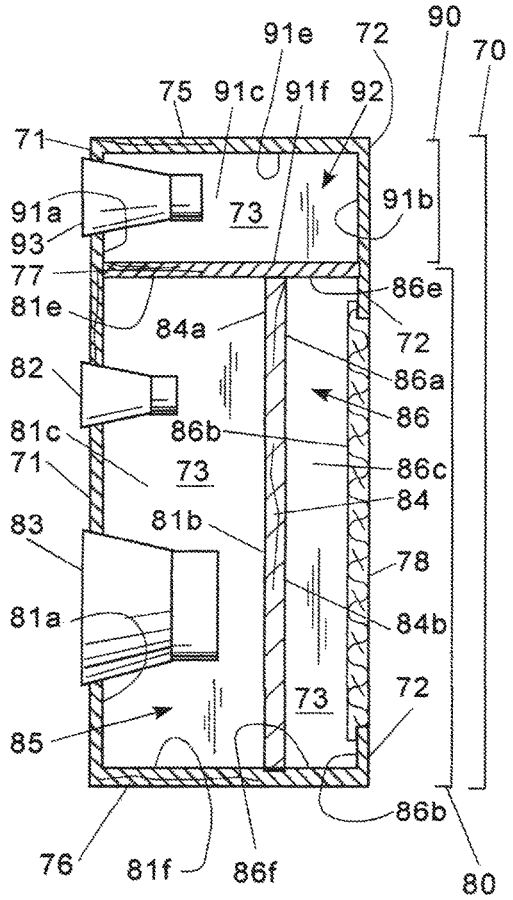
FIG. 12 is a side, cross-sectional view of the speaker system of FIG. 1.
Figure 13:
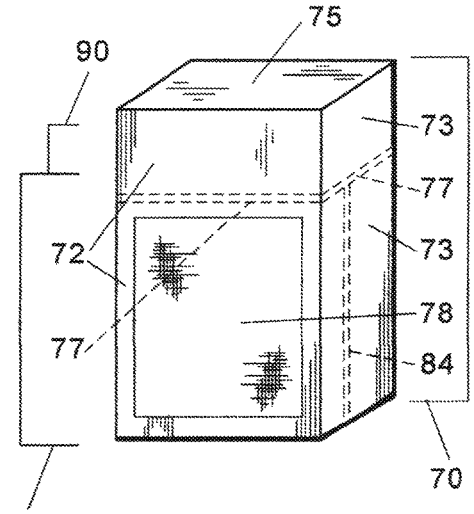
FIG. 13 is a back perspective view of a speaker system of the present invention shown in FIG. 11.
Figure 14:
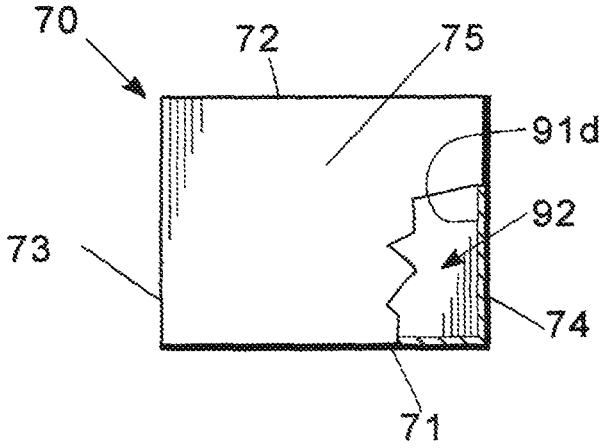
FIG. 14 is a top elevation view, partly broken away, of the speaker system of the present invention shown in FIG. 11.
Figure 15:
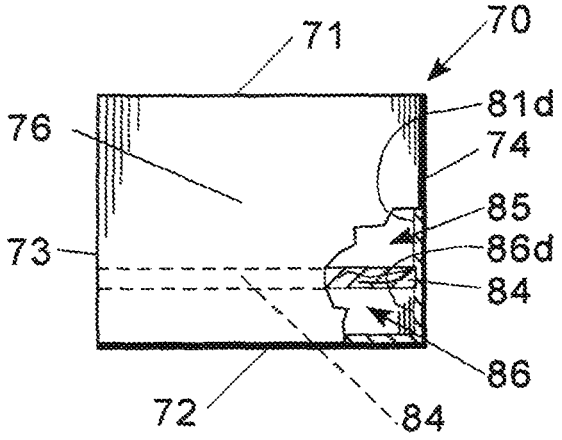
FIG. 15 is a bottom elevation view, partly broken away, of the speaker system of the present invention shown in FIG. 11.

With reference to FIGS. 11-15, there is shown still another broad embodiment of the present invention speaker system generally indicated by numeral 70 including a housing enclosure 70 comprising a plurality of walls 71-77 to form at least two cabinet compartments generally indicated by numerals 80 and 90. The first cabinet compartment enclosure 80 shown in FIGS. 11-15 may be generally the same as the first cabinet enclosure 20 shown in FIGS. 1-5. In this embodiment, the first cabinet compartment enclosure 80 is a highly resonant rectangular housing enclosure 80 formed by six panel interior surface portions 81*a*-81*f*.

The interior of the first cabinet compartment enclosure 80 includes a first driver 82, a second driver 83 and a planar partition soundboard 84. The first driver 82, the second driver 83 and soundboard 84 may be the same as the first driver 22, the second driver 23 and soundboard 24, respectively, as described above with reference to FIGS. 1-6. In the embodiment shown in FIGS. 11-15, the speaker system 70 includes (i) at least the first cabinet compartment 80 having (a) at least a first interior compartment space 85 and (b) a second interior compartment space 86, the spaces 85 and 86 being partitioned by the planar partition soundboard 84; and the speaker system 70 includes (ii) at least the second cabinet compartment 90 having at least a third interior compartment space 92. The walls 71-76 form the housing enclosure structure of the speaker system 70 of the present invention; and the housing enclosure for the speaker system 70 is a generally rectangular housing with the following six sides (walls or panels): a front wall 71, a back wall 72, a first side wall 73, a second side wall 74, a top wall 75, and a bottom wall 76. A planar partition coterminous wall 77 is also included in the speaker system 70; and the wall 77 divides the first cabinet compartment 80 from the second cabinet compartment 90 such that the first interior compartment space 85 and the second interior compartment space 86 are separated from the third interior space 92 by the planar partition coterminous wall 77.

Generally, the planar partition coterminous wall 77 may be disposed in a horizontal plane between, and parallel to, the top wall 75 and the bottom wall 76; and disposed in a horizontal plane between, and perpendicular to, the inside surface of the front wall 71, back wall 72, first side wall 73 and second side wall 74 such that the first interior and second interior compartment spaces, 85 and 86 of compartment 80, are separated from the third interior space 92 of the second cabinet compartment 90.

In the embodiment shown in FIGS. 11-15, the first interior compartment space 85, a first rectangular enclosure or space, is formed by six panel interior surface portions 81*a*-81*f*. The six panel interior surface portions forming the first interior enclosure or space 85 include an interior surface portion 81*a*, an interior surface portion 81*b*, an interior surface portion 81*c*, an interior surface portion 81*d*, an interior surface 81*e*, and an interior surface portion 81*f*. A portion of the interior surface of the front wall 71 comprises the interior surface portion 81*a* facing the interior space 85. The front surface 84*a* of the soundboard partition 84 comprises the interior surface portion 81*b* facing the interior space 85. A portion of the interior surface of the side wall 73 comprises the interior surface portion 81*c* facing the interior space 85. A portion of the interior surface of the side wall 74 comprises the interior surface portion 81*d* (shown in FIG. 15) facing the interior space 85. A portion of the bottom surface of the planar partition coterminous wall 77 (which is the common wall to the compartment spaces 85/86 and the compartment space 92) comprises the interior surface portion 81*e* facing the interior space 85. And, a portion of the top surface of the bottom wall 76 comprises the interior surface portion 81*f* facing the interior space 85.

Again, with reference to FIGS. 11-15, the second interior compartment space 86, a second rectangular enclosure or space in the cabinet portion 80, is formed by six panel interior surface portions 86*a*-86*f*. The six panel interior surface portions forming the interior enclosure 86 include an interior surface portion 86*a*, an interior surface portion 86*b*, an interior surface portion 86*c*, an interior surface portion 86*d*, an interior surface 86*e*, and an interior surface portion 86*f* The back surface 84*b* of the soundboard partition 84 comprises the interior surface portion 86*a* facing the interior space 86. The interior surface portion of the back wall 72 in combination with the interior front surface of the panel 78 comprises the interior surface portion 86*b* facing the interior space 86. A portion of the interior surface of the side wall 73 comprises the interior surface portion 86*c* facing the interior space 86. A portion of the interior surface of the side wall 74 comprises the interior surface portion 86*d* (shown in FIG. 15) facing the interior space 86. A portion of the bottom surface of the planar partition coterminous wall 77 (which is the common wall to the compartment spaces 85/86 and the compartment space 92) comprises the bottom surface portion 86*e* facing the interior space 86. And, a portion of the top interior surface of the bottom wall 76 comprises the interior surface portion 86*f* facing the interior space 86.

Additionally, in the embodiment shown in FIGS. 11-15, the third interior compartment space 92 of the cabinet compartment 90 is a third rectangular enclosure or space and is formed by the interior surfaces of six panel surfaces 91*a*-91*f*. The interior six panel surfaces forming enclosure 92 include an interior surface portion 91*a*, an interior surface portion 91*b*, an interior surface portion 91*c*, an interior surface portion 91*d*, an interior surface portion 91*e*, and an interior surface portion 91*f*. A portion of the interior surface of the front wall 71 comprises the interior surface portion 91*a* facing the interior space 92. A portion of the interior surface of the back wall 72 comprises the interior surface portion 91*b* facing the interior space 92. A portion of the interior surface of the side wall 73 comprises the interior surface portion 91*c* facing the interior space 92. A portion of the interior surface of the side wall 74 comprises the interior surface portion 91*d* (shown in FIG. 14) facing the interior space 92. The interior surface of the top wall 75 comprises the interior surface portion 91*e* facing the interior space 92. And, the top interior surface of the planar partition coterminous wall 77 comprises the interior surface portion 91*f* facing the interior space 92. The planar partition coterminous wall 77 is the common wall to, and divides, the compartment spaces 85 and 86 from the compartment space 92.

The soundboard 84 can be made from wood of highly resonant character such as spruce, maple, and the like. In the embodiment shown in FIGS. 11-15, the space 86 is formed between the soundboard 84 and back panel 72/78 as described above. A first driver 82, a second driver 83, and a soundboard 84 are disposed in the first cabinet compartment 80; and a third driver 93 is disposed in the second cabinet compartment 90.

Although not shown in FIGS. 1-15, the present invention may be trivially altered or have various optional components added to it without making significant conceptual or practical advancements. Elements of the present invention may be configured in ways that are somewhat different from the configurations represented in FIGS. 1-15. For example, in one optional embodiment, the back panel of the cabinets (e.g., back panel 24 of FIG. 1) may be designed to be a solid panel rather than a porous panel. In another optional embodiment, ports may be added to the cabinet walls such as the back panel can be a solid panel and vented with one or more ports; and the ports may be altered in size, moved, or eliminated altogether. In still another optional embodiment, the soundboard can be mounted (using, for example, thin metal brackets (not shown)) such that the soundboard would be affixed only at specific points of wall surfaces and such that the soundboard is allowed to resonate even more than if the soundboard was glued down via the entire edges around the interior of the cabinet walls. In still another optional embodiment, the front panel may be covered with speaker cloth fabric to protect the speakers from dust and to improve appearance. For example, in yet another optional embodiment, the enclosures may be built with stands or on legs, and/or the crossover networks may be altered so that crossover points differ. None of the above-mentioned alterations should be construed as a significant variation to the core concept of the present invention represented and claimed herein.

Another embodiment of the present invention is directed to a process of increasing the resonance of a speaker system. In one broad embodiment, the process provides the construction of a unique speaker system design that includes, for example. (a) at least a first enclosure having a plurality of walls forming at least a first compartment having at least a first interior compartment space; (b) at least a first driver having a frequency of greater than about 20 Hz; (c) at least a second driver having a frequency of less than about 20,000 Hz; (d) at least a third driver having a frequency of from about 100 Hz to about 4,000 Hz; and (e) at least a first soundboard. In a first embodiment of the present invention process, the at least first driver (b), the at least second driver (c), and the at least first soundboard (e) may be disposed in the at least first interior compartment space; and the at least third driver (d) may be disposed external to the at least first compartment such that the at least third driver (d) can be partitioned off, separated and apart, or isolated from the at least first driver (b), the at least second driver (c) and the at least first soundboard (e). In this embodiment, the combination of the at least first, second and third drivers and the at least first soundboard increases the resonance of, and enhances the quality of, the sound from the speaker system.

In a second embodiment of the present invention process, the at least first driver (b), the at least second driver (c), and the at least first soundboard (e) may be disposed in the at least first interior compartment space; and the at least third driver (d) may be disposed in at least a second enclosure having a plurality of walls forming at least a second compartment having at least a second interior compartment space. In this embodiment, the at least third driver (d) may be disposed in the second compartment such that the third driver can be partitioned off, separated and apart, or isolated from the at least first driver (b), the at least second driver (c) and the at least first soundboard (e) which may be disposed in the first compartment space. Also, in this embodiment, the at least first cabinet enclosure may be of a first size and the at least second cabinet enclosure may be of a second size different from the first cabinet enclosure. For example, the second cabinet enclosure may be smaller in size than the first cabinet enclosure. In addition, the planar partition soundboard member may be placed in the at least first cabinet enclosure such that the soundboard member may be adapted for enhancing the quality of sound from the speaker system.

In still a third embodiment of the present invention process, the speaker system may provide at least an overall housing enclosure that may be divided into at least two compartments separated by at least one first planar coterminous wall partition member. The planar coterminous wall partition member may be mounted in the enclosure interior to divide the overall enclosure interior into a first compartment having a first interior and a second compartment having a second interior separated by the at least first planar coterminous wall partition member.

In this third embodiment, the first compartment having a first interior compartment space can be used for enclosing the first driver, the second driver and the soundboard; and the second compartment having a second interior compartment space can be used for enclosing the third driver. By disposing the at least first driver (b), the at least second driver (c), and the soundboard (e) in the at least first compartment; and by disposing the at least third driver (d) in the at least second compartment such that the first interior compartment space and the second interior compartment space are separated by the first planar partition member forming a planar partition coterminous wall between the first and second interior compartment spaces, the quality of sound from the speaker system can be improved or enhanced. In any of the embodiments described above, any one or more of the drivers may be mounted in the front panel such that the drivers are flush or slightly recessed so that the use of a speaker cloth will cover the drivers m in a more attractive manner.

The apparatus and process of the present invention are not to be limited by the specific examples set forth above. Rather, the above-described embodiments and specific examples; and the foregoing description of the present invention, particularly any reference to "preferred" embodiments, are merely possible examples of implementations, and are merely set forth for a clear understanding of the principles of the present invention. Further, numerous variations and modifications may be made to the above-described embodiments of the present invention, by those skilled in the art, without departing substantially from the spirit and principles of the present invention. Thus, it is not desired to limit the present invention to the exact construction and operation shown and described herein. Accordingly, all such modifications and variations are intended to be included herein within the scope of this disclosure and the present invention; and intended to be protected by the following claims.

What is claimed is:

1. A speaker system comprising:

(a) at least a first enclosure having a plurality of walls forming at least a first compartment having at least a first interior compartment space;

(b) at least a first driver having a frequency of greater than about 20 Hz;

(c) at least a second driver having a frequency of less than about 20,000 Hz;

(d) at least a third driver having a frequency of from about 100 Hz to about 4,000 Hz; and (e) at least a first soundboard;

wherein the at least first driver (b), the at least second driver (c), and the at least first soundboard (e) are disposed in the at least first interior compartment space of the at least a first enclosure; and wherein the at least a third driver is disposed external to the at least first compartment of the at least first enclosure such that the at least third driver is separate from the at least first driver (b), the at least second driver (c) and the at least first soundboard (e); and wherein the combination of the at least first, second and third drivers and the at least first soundboard increases the resonance of, and enhances the quality of, the sound from the speaker system.

2. The speaker system of claim 1, wherein the at least a third driver is: (i) disposed external to the at least first compartment, (ii) attached to the exterior surface of at least one of the walls of the at least first enclosure, and (iii) exposed to the atmosphere.

3. The speaker system of claim 1, including at least a second enclosure separate and different from the at least first enclosure; wherein the second enclosure has a plurality of walls forming at least a second compartment having at least a second interior compartment space; and wherein the at least second enclosure encloses the at least third driver (c) disposed in the at least second interior compartment space.

4. The speaker system of claim 3, wherein the size and wall dimensions of the at least second enclosure is smaller than the size and wall dimensions of the at least first enclosure.

5. The speaker system of claim 1, wherein the at least first enclosure has a plurality of walls forming: (i) at least a first compartment having at least a first interior compartment space, and (ii) at least a second compartment having at least a second interior compartment space;

wherein the first interior compartment space and the second interior compartment space are separated by a planar partition coterminous wall between the first and second interior compartment spaces; and wherein the at least first driver (b), the at least second driver (c), and the soundboard (e) are disposed in the at least a first compartment; and wherein the at least third driver (d) is disposed in the at least second compartment.

6. The speaker system of claim 1, wherein the planar partition soundboard member is a material having a density of from about 0.16 kg/m$^3$ to about 1.3 kg/m$^3$.

7. The speaker system of claim 1, wherein the soundboard material is wood.

8. The speaker system of claim 1, wherein the soundboard material is spruce.

9. The speaker system of claim 1, wherein the resonance of the first cabinet enclosure is increased by at least 10 percent.

10. The speaker system of claim 2, wherein the at least a first enclosure comprises (A) at least a first cabinet enclosure of a first size; wherein the at least first cabinet enclosure includes:

(i) a bottom panel, (ii) a pair of side panels upward-standing from said bottom panels in spaced relationship, (iii) a rear panel upward-standing from said bottom panel, (iv) a front panel upward-standing from said bottom panel in spaced relationship with respect to said rear panel; wherein the front panel includes at least a first driver slot and at least a second driver slot, (v) a top panel carried by said side panels, front panel and rear pane; wherein the front panel, the side panels, the top panel and the rear panel defines the first cabinet enclosure, and wherein the first cabinet enclosure defines an enclosure interior;

(vi) at least a first speaker mounted in said first driver slot in the front panel and speaker wiring connected to said speaker for electrically energizing said speaker;

(vii) at least a second speaker mounted in said second driver slot in the front panel and speaker wiring connected to said speaker for electrically energizing said speaker;

(viii) a planar partition soundboard member; wherein the partition soundboard member is mounted between said side panels in said enclosure interior in closely spaced relationship with respect to said rear panel for dividing said enclosure interior; wherein the partition soundboard member is mounted in a vertical plane parallel to the vertical plane of the from panel, perpendicular to the vertical planes of the side panels, and perpendicular to the horizontal planes of the top and bottom panels such that at least two interior spaces are formed including a front interior space between the front panel and the soundboard member and a back interior space between the soundboard member and the rear panel; wherein the planar partition soundboard member forms a coterminous wall between the front interior space and the back interior space and; wherein the partition soundboard member is adapted for enhancing the quality of sound from said first cabinet enclosure.

11. The speaker system of claim 3, wherein the at least a second enclosure comprises:

(B) at least a second cabinet enclosure separate and different from the first enclosure; wherein the at least a second cabinet enclosure is of a second size smaller than the first cabinet enclosure; wherein the at least second cabinet enclosure includes:

(i) a bottom panel, (ii) a pair of side panels upward-standing from said bottom panels in spaced relationship, (iii) a rear panel upward-standing from said bottom panel, (iv) a front panel upward-standing from said bottom panel in spaced relationship with respect to said rear panel; wherein the front panel includes at least a third driver slot;

(v) a top panel carried by said side panels, front panel and rear pane; wherein the front panel, the side panels, the top panel and the rear panel defines the second cabinet enclosure, and wherein the second cabinet enclosure defines a second enclosure interior; and (vi) at least a third speaker mounted in said third driver slot in the front panel of the at least second cabinet enclosure; and wherein speaker wiring is connected to said third speaker for electrically energizing said speaker; wherein the at least second cabinet enclosure having the at least third speaker in combination with the at least first cabinet enclosure having the at least first and second speakers enhances the quality of sound from said speaker system.

12. The speaker system of claim 5, wherein the at least a first enclosure comprises (A) at least a first cabinet enclosure of a first size; wherein the at least first cabinet enclosure includes:

(i) a bottom panel, (ii) a pair of side panels upward-standing from said bottom panels in spaced relationship, (iii) a rear panel upward-standing from said bottom panel, (iv) a front panel upward-standing from said bottom panel in spaced relationship with respect to said rear panel;

(v) a top panel carried by said side panels, front panel and rear pane; wherein the front panel, the side panels, the top panel and the rear panel defines the first cabinet enclosure, and wherein the first cabinet enclosure defines an enclosure interior;

(vi) at least a first planar coterminous wall partition member mounted between said side panels in said enclosure interior in a spaced relationship with respect to the bottom panel and the top panel for dividing the first enclosure interior into at least two compartments separated by the at least first planar coterminous wall partition member including:

(α) at least a first compartment having at least a first interior compartment space, (β) at least a second compartment having at least a second interior compartment space;

wherein the first partition member is mounted in a horizontal plane parallel to the horizontal plane of the bottom panel and top panel, and perpendicular to the vertical planes of the side panels and perpendicular to the front and rear panels; and wherein the first interior compartment space and the second interior compartment space are separated by the first planar partition member forming a planar partition coterminous wall between the first and second interior compartment spaces;

(vi) wherein a portion of the front panel in front of the first compartment includes at least a first driver slot and at least a second driver slot for receiving the first and second drivers, respectively, (vii) at least a first speaker mounted in said first driver slot in the front panel portion of the first compartment and speaker wiring connected to said speaker for electrically energizing said speaker;

(viii) at least a second speaker mounted in said second driver slot in the front panel portion of the first compartment and speaker wiring connected to said speaker for electrically energizing said speaker;

(ix) a planar partition soundboard member; wherein the partition member is mounted between said side panels of the first compartment in closely spaced relationship with respect to said rear panel of the first compartment for dividing said first compartment interior space into at least two spaces; wherein the partition soundboard member is mounted in a vertical plane parallel to the vertical plane of the front panel, perpendicular to the vertical planes of the side panels, and perpendicular to the horizontal planes of the top and bottom panels of the first compartment such that at least two interior spaces are formed in the first compartment including a front interior space between the front panel and the soundboard member and a back interior space between the soundboard member and the rear panel; wherein the planar partition soundboard member forms a coterminous wall between the front interior space and the back interior space and wherein the partition soundboard member is mounted in a vertical plane parallel to the vertical plane of the front panel of the first compartment and perpendicular to the vertical planes of the side panels of the first compartment; wherein the partition soundboard member is adapted for enhancing the quality of sound from the speaker system;

(x) wherein a portion of the front panel in front of the second compartment includes at least a third driver slot;

(xi) at least a third speaker mounted in said third driver slot in the front panel portion of the second compartment and speaker wiring connected to said third speaker for electrically energizing said speaker;

wherein the at least first driver (b), the at least second driver (c), and the soundboard (e) are disposed in the at least a first compartment; and wherein the at least third driver (d) is disposed in the at least second compartment.

13. A process of increasing the resonance of a speaker system comprising the steps of:

(I) providing a speaker system including:

(a) at least a first enclosure having a plurality of walls forming at least a first compartment having at least a first interior compartment space;

(b) at least a first driver having a frequency of greater than 20 Hz;

(c) at least a second driver having a frequency of less than 20,000 Hz;

(d) at least a third driver having a frequency of from about 100 Hz to about 4,000 Hz; and (e) at least a first soundboard;

(II) disposing the at least first driver (b), the at least second driver (c), and the at least first soundboard (e) in the at least first interior compartment space; and (III) disposing the at least third driver external to the at least first compartment such that the at least third driver is separate from the at least first driver (b), the at least second driver (c) and the at least first soundboard (e); and such that the combination of the at least first, second and third drivers and the at least first soundboard increases the resonance of, and enhances the quality of, the sound from the speaker system.

14. The process of claim 13, wherein the resonance of the first enclosure is increased by at least 10 percent.

* * * * *